US008296910B1

(12) United States Patent
Blair et al.

(10) Patent No.: US 8,296,910 B1
(45) Date of Patent: Oct. 30, 2012

(54) MULTIFUNCTIONAL CLIP APPARATUS AND METHOD OF USE

(76) Inventors: Lisa P. Blair, Oklahoma City, OK (US); Karen A. Chaudry, Oklahoma City, OK (US)

( * ) Notice: Subject to any disclaimer, the term of this patent is extended or adjusted under 35 U.S.C. 154(b) by 1152 days.

(21) Appl. No.: 12/156,549

(22) Filed: May 30, 2008

(51) Int. Cl.

| | |
|---|---|
| ***A44B 99/00*** | (2010.01) |
| ***A44C 1/00*** | (2006.01) |
| *A44C 13/00* | (2006.01) |
| *A44C 15/00* | (2006.01) |

(52) U.S. Cl. ..... 24/351; 24/66.5; 24/66.6

(58) Field of Classification Search ..... 24/351–355, 24/66.5, 66.6

See application file for complete search history.

(56) References Cited

U.S. PATENT DOCUMENTS

| | | | | |
|---|---|---|---|---|
| 1,072,903 | A * | 9/1913 | Bippart | 24/353 |
| 1,085,552 | A * | 1/1914 | Dinuccio | 24/351 |
| 2,667,676 | A * | 2/1954 | Sampson | 24/355 |
| 2,837,806 | A * | 6/1958 | Hawie | 24/351 |

* cited by examiner

*Primary Examiner* — Robert J Sandy
(74) *Attorney, Agent, or Firm* — Bakos & Kritzer

(57) ABSTRACT

An ornamental device apparatus and method is disclosed for providing the utilization of a single set of ornamental devices to adorn a variety of fashion items by removably attaching the ornamental devices with a clip or pin assembly. The present invention further contemplates the combination of multiple ornamental devices into a single composite ornamental device.

20 Claims, 12 Drawing Sheets

MULTIFUNCTIONAL CLIP APPARATUS AND METHOD OF USE

FIELD OF THE INVENTION

The present invention generally relates to the field of fashion, primarily jewelry and clothing, accessories, and especially for an ornamental apparatus for use with multiple applications including the decoration of shoes, bags, purses, clothing, and the like. More specifically, the present invention relates to a system and method for allowing a plurality of ornamental devices to adorn and decorate multiple articles. In addition, the present invention allows the combination of a plurality of ornamental devices to removably attach to form a single ornamental device.

BACKGROUND OF THE INVENTION

The fashion industry is a fickle and ever-changing industry. Generally, there exists an incentive to introduce new trends in fashion, whether as stand-alone objects or items to adorn and decorate existing articles in new, innovative, and attractive ways. Over the years, several such devices have been created, propagated and imitated, including rings, bracelets, necklaces, brooches, clips, pins, shoe clips, etc. However, to outfit various articles of clothing one would have to acquire a number of different ornamental devices to accommodate each individual article. To date, a single set of devices which allow for the ornamental decoration of a variety of various articles including male, female, child, and animal apparel, accessories such as shoes and handbags, beauty objects, and home and entertaining design articles does not yet exist.

In addition to multiple objectives of the present invention, one of the primary objectives of the present invention is to provide a clip capable of adorning footwear. Such clips must be comfortable and generally non-intrusive to wearer. Focusing on this specific application of items capable of attaching to shoes, it is apparent that existing shoe devices fail in many regards. First, existing shoe ornament devices provide ineffective securing mechanisms for integrating the clips with footwear. Further, existing shoe ornament designs provide no level of comfort for the wearer as many securing mechanisms generally exhibit protruding portions which interfere with the comfort of the shoe and often create abrasions on the top portion of a user's foot due to the rubbing of the device on the user's foot. In addition, modern shoe ornament devices are generally manufactured for use by children, exhibiting inexpensive materials, adolescent favored designs, and are geared toward use with common tennis shoes or resin-based shoes. For example, one of the most common and well recognized fashion shoes of current seasons are commonly known as Crocs™. Crocs™ are primarily resin-based shoes manufactured with generally circular apertures which provide a comfortable and waterproof wearable item generally directed for use by adolescents. Crocs™ are often further adorned with articles commonly known as Jibbitz™. Jibbitz™ are ornamental items designed to be removably secured within the circular apertures of the Crocs™ with an upper portion exhibiting a design and a lower portion consisting of a "mushroom" base for inserting the item therein and resisting movement in the upper portion absent substantial force. However, these designs substantially move in place and are designed for a singular application with the Crocs™ and are not designed for a myriad of uses. Further, these "mushroom" portions protrude through the roof and the shoe housing interfering with the upper portion of a user's foot. Thus, there exists a need for a device that can be utilized as an ornamental decoration for a shoe that is designed for a myriad of uses. Further, the desired device must include an efficient and easily manufactured secure attachment system which does not interfere with the comfort of the shoe.

Few references are available from the United States Patent and Trademark Office which attempt to address the need for a shoe ornament device that provides increased comfort and enhanced securing mechanisms which limit the interaction with a user's foot. References directed to such shoe ornament devices generally relate to the use of various clips to attach external objects to a shoe. For example, the United States Patent and Trademark Office has reviewed patent applications purporting to provide solutions for (1) attaching an article to the laces of a shoe, (2) attaching a pant cuff to a shoe, and (3) attaching two shoes together to prevent theft, however, these systems have different objectives and exhibit many limitations, as each fails to provide an integrated system for decorating various articles of clothing or accessories. Further, the references fail to disclose a shoe ornament device capable of providing a comfortable assembly which does not interfere with the normal wear of the shoe.

A first reference, depicted in FIG. 1 (PRIOR ART) entitled "Shoe Clip" to Rooney et al. U.S. Pat. No. 7,152,286 is directed to a shoe clip for attaching a device to the laces of a shoe. More specifically, the attachment of such items as "coins, keys, identification race chips, computational devices and/or electronic devices" to the laces of a shoe would reliever the wearer from carrying the item in his or her pocket. It follows that an obvious object in the Rooney et al. disclosure is to purport to provide a simple, practical method of carrying small items in a container attached to the laces of a shoe. Like most prior shoe clips designed as simple shoe lace tie-ins with lace holes, the Rooney et al. device is comprised of a clipping mechanism capable of attaching only to shoe laces of a common tennis shoe or the like. Further, the Rooney et al. device merely overcomes the requirement of most prior art devices that the laces must be removed from the shoe and integrated with the laces before being replaced into the shoe eyelets. It will be readily apparent to those of ordinary skill in the art that Rooney et al. does not address the desired functionalities apparent with respect to the disclosure of the present invention.

Similarly, numerous well-known devices related to shoes are merely designed to hold a shoe lace at or around the knot to further allow a user to complete lacing a shoe. For example, Comp U.S. Pat. No. 754,851 entitled "Shoe Lace Holder" is directed an "improved shoe-lace holder for securing the knotted portion of a shoe-lace or other similar article when the same is tied or bowed." Importantly, in order for the Comp device to be employed, thereby securing the knot, a long portion of the device must extend and interact with a series of notches for closing the device. As a result, one of the disadvantages of the Comp system is that the aforementioned long portion must be of a specific dimension to reach beyond the lace and lock thereto. Thus, no portion of the lace must interfere with the locking mechanism. Clearly, this type of device can not be utilized on shoes that lack shoe laces, on accessories such as purses, or on home design devices such as vases, baskets, etc.

Turning to another shoe lace retaining device, Maxwell et al. U.S. Pat. No. 3,290,745, entitled "Shoe Lace Clasp," discloses a shoe lace device adapted to secure portions of a shoe lace to avoid the necessity of tying the laces as in a loop form. Specifically the Maxwell et al. invention is designed to allow a user to merely slip on a shoe and clasp the laces together in one easy step. Numerous adaptations of this system are apparent in present day shoe manufacture. However, this device, and its progeny (such as Meier U.S. Pat. No. 3,473,198 entitled "Shoe Tie Retainer" and Anderson U.S. Pat. No. 4,949,437 entitled "Shoelace Knot Retaining Apparatus"), are merely designed to link to the laces of a shoe and avoid the tying of a shoe by a user and is not geared to improved ornamental clips for adhering to myriad of products thereby improving the aesthetic of the products.

Turning to a clothing-related system, Carter U.S. Pat. No. 7,086,123 discloses a "Cuff Clip Jewelry Device" for preventing the cuff of a baggy pant leg from dropping below the heel of a shoe and being dragged on the ground. The Carter disclosure clearly recognizes that an ornamental device for attachment to various articles of clothing is desirable; however, the Carter disclosure, as depicted in FIG. 2 (PRIOR ART), is drawn merely to a single use. Specifically, Carter discloses the use of a decorative charm having a U-shaped shoe clip for attaching one end of the decorative charm to a shoe. The other end of the decorative charm of the Carter device is attached to the cuff of a baggy pant leg. As a result, the Carter disclosure offers a unique decorative solution to the problem of a baggy pant leg dragging along the ground. However, the apparatus disclosed by Carter is directed to a single use/single application and does not offer a plurality of uses for the decorative charm. In addition, the Carter apparatus is merely directed to a system for preventing damage to a pant leg and the disclosure fails to address the comfort level experienced by a user.

Simpson U.S. Pat. No. 5,867,874 discloses a clip apparatus for use with a clothing accessory product. Specifically, Simpson is directed to an "Implement Holder Attached to a Hat or Cap." In short, this disclosure is primarily directed to providing a pen or pencil u-shaped cradle affixed to the lower portion proximal the edge of a cap. It is further disclosed that a similar apparatus may be designed to affix to a pair of eyeglasses or sunglasses. Clearly the Simpson device is limited to its specific stated purpose.

Turning to another application, a visor clip is disclosed in Miles U.S. Pat. No. 6,477,744. The clip disclosed by Miles is designed to sustain substantial vibrations due to the mobility of a vehicle when attached to a vehicle sun visor and includes a series of clips for holding a series of items such as a writing implement (e.g., a pencil). Again this device is merely limited to its intended purpose and is not designed for a myriad of uses.

Thus it is apparent that various clips have been used for many years to hold or grip a variety of items on a second item or structure and an almost infinite number of examples of items connected together by clips over a period of centuries can be found. While numerous other designs of clips geared for specific uses are well-known in the art, it is evident that a need exists for an apparatus capable of removably attaching to various articles of clothing whereby a single system of ornamental items can be utilized to decorate a plurality of articles. In addition, a need exists for an ornamental shoe clip apparatus to decorate a pair of shoes and increase the comfort of the wearer. Further, there exists a need in the art to provide a single securing apparatus which a user may attach to various objects including fashion accessories, home design accessories, pet products and accessories, beauty objects, or any other device which exhibits an area suitable for affixing an ornamental clip thereto.

SUMMARY OF THE INVENTION

The present invention provides an apparatus and method for decorating a plurality of articles with a substantially common device designed for a myriad of applications.

In the various embodiments disclosed herein it is a primary object of the present invention to provide a simple, comfortable, and effective ornamental apparatus capable of securing to a portion of a shoe at or about the tongue portion of the shoe without linking directly to the laces or requiring a user to position by linking a portion of the laces therethrough.

It is a further object of the present invention to provide a simple and effective single securing apparatus which a user may attach to various objects including fashion accessories, home design accessories, pet products and accessories, beauty objects, or any other device which exhibits an area portion suitable for affixing an ornamental clip thereto.

It is another object of the present invention to provide a simple device comprising multiple ornamental apparatus which can be combined to form a single composite ornamental apparatus.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment and alternate embodiments set forth in the illustrations of the accompanying drawings. Although the illustrated embodiments are merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

DETAILED DESCRIPTION OF THE PREFERRED EMBODIMENT

A detailed illustrative embodiment as well as several alternate embodiments of the present invention are disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiments for purposes of disclosure and to provide a basis for the claims herein which define the scope of the present invention. The following presents a detailed description of a preferred embodiment (as well as some alternative embodiments) of the present invention.

Moreover, well known methods, procedures, and substances for both carrying out the objectives of the present invention and illustrating the preferred embodiment are incorporated herein but have not been described in detail as not to unnecessarily obscure novel aspects of the present invention.

Figure 1:
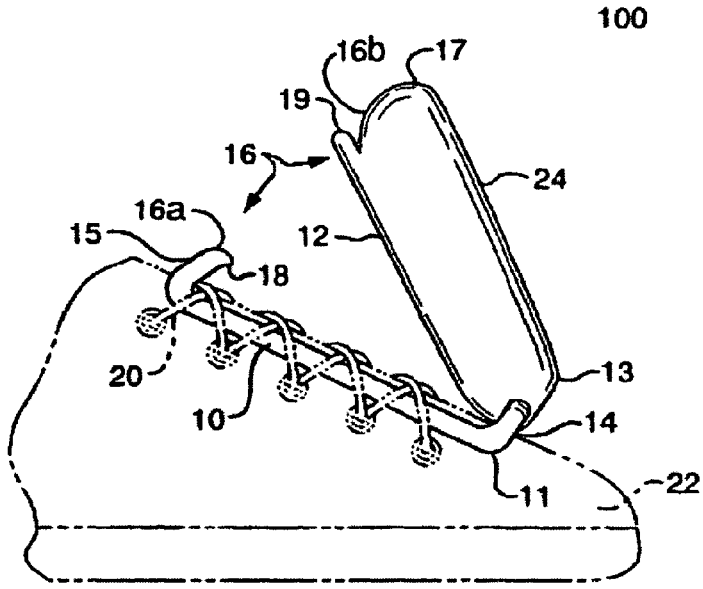
FIG. 1 (PRIOR ART)
FIG. 1 (PRIOR ART) shows the Rooney et al. U.S. Pat. No. 7,152,286 prior art entitled "Shoe Clip" depicting an apparatus for carrying objects in a container connected to the laces of a shoe.
Figure 2:
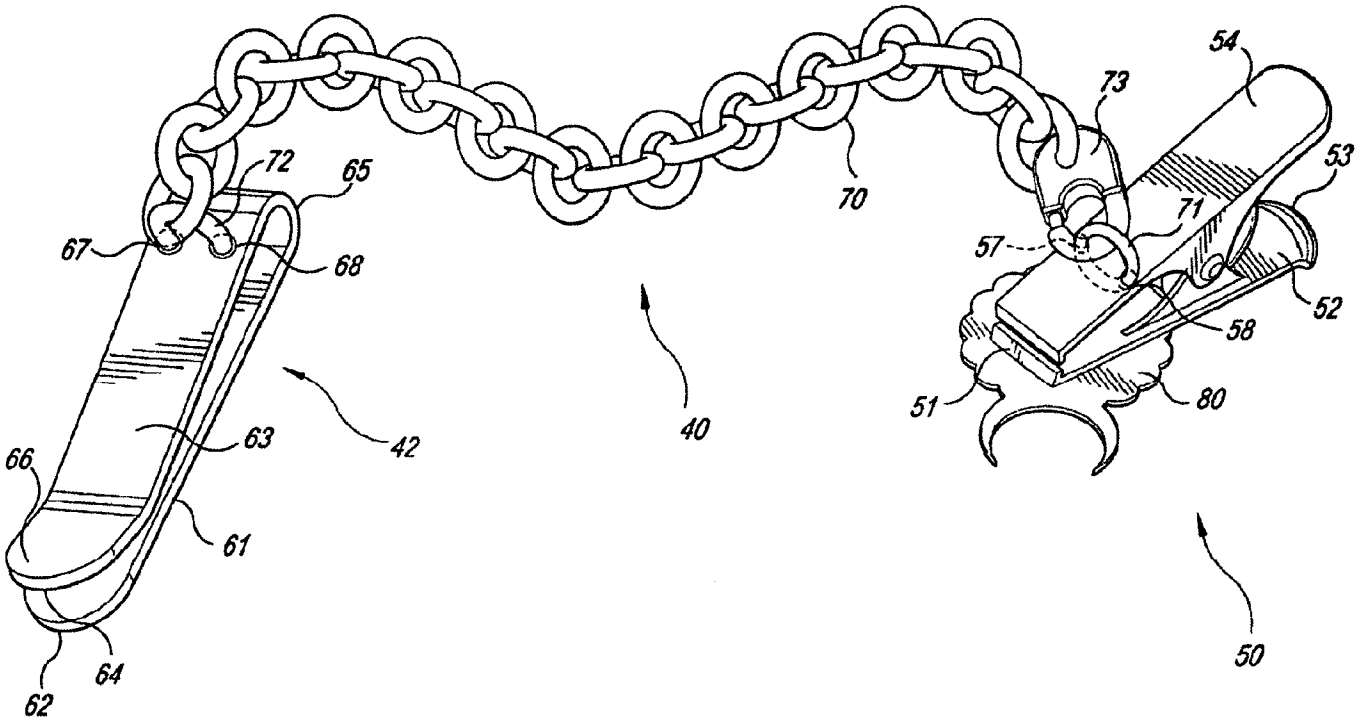
Fig. 2 (PRIOR ART)
FIG. 2 (PRIOR ART) shows the Carter U.S. Pat. No. 7,086,123 prior art entitled "Cuff Clip Jewelry Device" depicting a jewelry item for attaching the cuff of a baggy pant leg to the heel of a shoe in order to prevent dragging of the pant leg along the ground.
Figure 3:
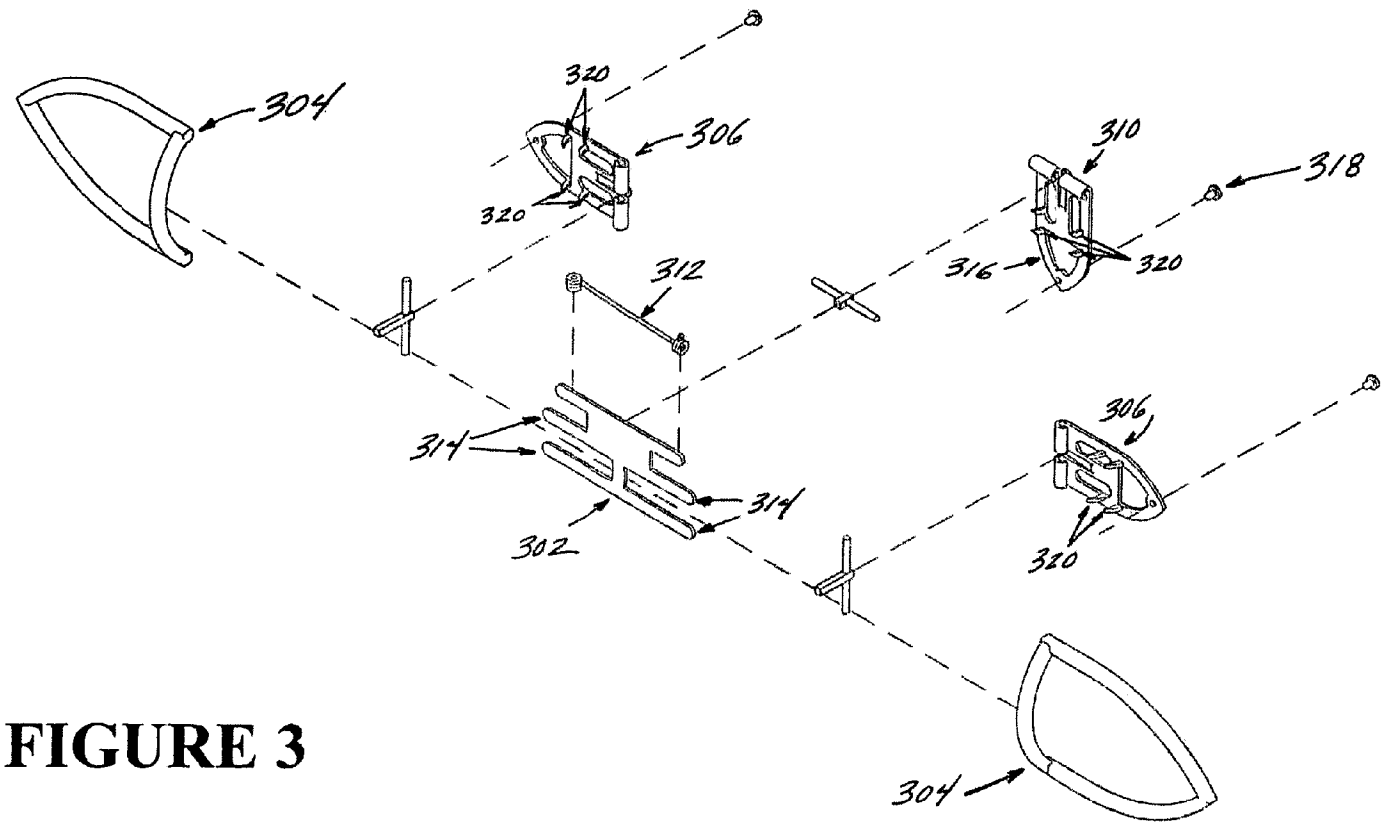
FIG. 3 depicts a front angular view of the attachment device in relation to the ornamental clips in accordance with the preferred embodiment of the present invention.

Referring first to FIG. 3, depicted is an illustration of the apparatus in accordance with the preferred embodiment of the present invention. Specifically, the present invention is directed to an attachment device 302 as interconnected with ornamental devices 304. Generally, ornamental devices 304 are shoe clips or similar ornamental pieces, including but not limited to brooches, pins, tie-tacks and clips. Attachment device 302 can be manufactured of any common material known in the art and in the preferred embodiment attachment device 302 is manufactured of a precious, semi-precious or non-precious metal, plastic, or any other preferably stiff, rigid and lightweight material, or any composites of the referenced materials or other like materials common in the art. Further, attachment device can be manufactured as a solid piece with hinge 310 and pin 312 connected, or as a composite of several independent units whereby hinge 310 and pin 312 are removably attached. While these embodiments are preferable based on the current state of the art, one of ordinary skill in the art will recognize that attachment device 302 can be manufactured in a wide variety of shapes or embodiments.

Attachment device 302 can be manufactured of various sizes conforming to the various standards in the art. In the preferred embodiment, it has been determined that attachment device 302 generally measures four to six inches in length and two to four inches in width to accommodate uses including a brooch, pin, pendant or belt buckle. Generally, due to the varying properties with respect to various interchangeable uses, the dimensions of attachment device 302 may be widely varied without departing from the scope of the present invention. Attachment device 302 is connected at attachment prongs 314 to ornamental device clips 306 of ornamental devices 304 as will be described in greater detail below.

Still referring to FIG. 3, in the preferred embodiment of the present invention attachment device is depicted having clip hinge 310 for securing ornament devices 304 thereto. Clip hinge 310 can be manufactured of the same or like material as attachment device 302 in order to provide uniformity of the product. One of ordinary skill in the art will readily recognize that hinge 310 can be manufactured from any known material without departing from the scope of the invention.

The depiction of FIG. 3 illustrates the use of ornamental devices 304. These ornamental devices can be manufactured as shoe clips, belt buckles, brooches, pendants or other similar ornamental device. Ornamental device 304 is preferably designed to display jewels or other ornaments (or any other design) outwardly while maintaining a connection with an object such as an article of clothing. Such use is described in greater detail below.

Still referring to FIG. 3, attachment device 302 includes attachment prongs 314, attachment device clip 316 and pin 312. In accordance with the preferred embodiment of the present invention, attachment prongs 314 are utilized to attach the generally semi cylindrical end of each of ornamental devices 304 at each end of attachment device 302. It should be noted that while ornamental devices 304 are shown as having a semi cylindrical end in the embodiment depicted in FIG. 3, ornamental devices 304 may be constructed in any shape or form without departing from the scope of the present invention. In addition, in accordance with the preferred embodiment of the present invention, attachment device clip 316 is utilized to fasten attachment device 302 (with or without a combination of ornamental devices 304) to a fashion item, including, but not limited to a shirt, blouse, purse, belt, home accessory, dog collar, etc. Attachment device clip 316 operates by rotating on clip hinge 310 in order to fasten to a fashion device, and further contains pinching devices 320 to assist in the fastening of attachment device 302 to a fashion item and to prevent slippage. Similarly, pin 312 can be utilized to fasten attachment device 302 to a fashion item either alone or in conjunction with attachment device clip 316. As with attachment device 302, attachment prongs 314, attachment device clip 316 and pin 312 can be manufactured of any common material known in the art, including precious, semi-precious or non-precious metal, plastic, or any other preferably stiff and lightweight material, or any composites of the referenced materials or other like materials common in the art.

Still referring to FIG. 3, depicted is stopper device 318 attached to one end of attachment device clip 316. In accordance with the preferred embodiment of the present invention, stopper device 318 is manufactured from a soft and flexible material such as rubber, resin, polypropylene, or polyurethane, although one of ordinary skill in the art will recognize that various soft and flexible material can be utilized without departing from the scope of the present invention. Stopper device 318 is utilized to maintain a coefficient of friction greater than that of the metallic surface of attachment device clip 316 to decrease slippage of attachment device clip 316 when in contact with a fashion item such as a shirt, blouse, belt or dog collar. In addition, stopper device 318 operates to prevent slippage of attachment device clip 316 when attached to such fashion items as a necklace or bracelet. Stopper device 318 also provides extra comfort to the wearer of such a device as the wearer feels contact with the soft and flexible material as opposed to the more rigid material utilized in construction of attachment device 302 or attachment device clip 316.

Figure 4:
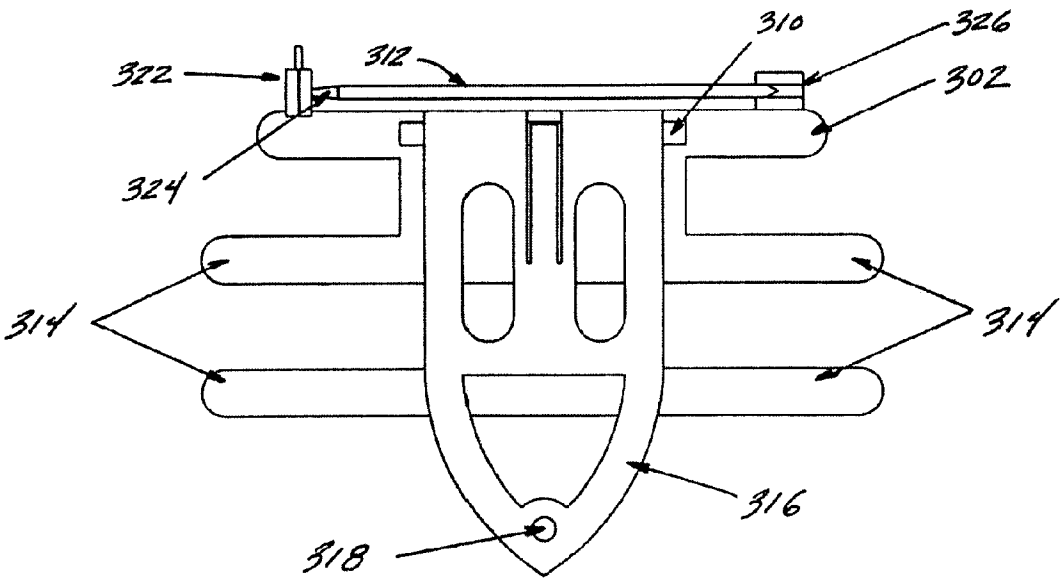
FIG. 4 depicts a rear planar view of the attachment device of FIG. 3 in accordance with the preferred embodiment of the present invention.

Turning next to FIG. 4, shown is a rear planar view of attachment device 302 in accordance with the preferred embodiment of the present invention. More specifically, the integration of pin 312 and attachment device clip 316 with attachment device 302 is depicted in greater detail. Pin 312 and attachment device clip 316 are depicted in the closed position as would exist when the present invention is connected to a fashion item. Attachment device clip 316 is perpendicularly affixed to a top end of attachment device 302 at clip hinge 310 including attachment prongs 314 for affixing ornamental portions thereto. In addition, stopper device 318 is connected at a bottom pointed end of attachment device clip 316 so as to provide contact to the fashion item as depicted in the closed position. In the preferred embodiment depicted in FIG. 4, attachment prongs 314 are located on the side ends of attachment device 302 and extend beyond attachment device clip 316 so as to provide ample extension portions for affixing ornamental portions thereto. Pin 312 is designed and affixed at pin hinge 326 at a location so as to not interfere with the movement and extension of attachment device clip 316. Pin 312 is designed in a safety manner so as to further not interfere when attachment device clip 316 is affixed to a desired object and further includes pointed end 324 for securing at loop portion 322 to prevent movement thereof when affixed to desired object. Attachment device clip 316 is designed with sufficient tension so as to roughly lock in place and prevent substantial movement as a result of vibration when adorned to an object or movement associated with an object. Further, attachment device clip 316 is designed to affix yet be removed with sufficient force of an ordinary user of attachment device clip 316.

Figure 5:
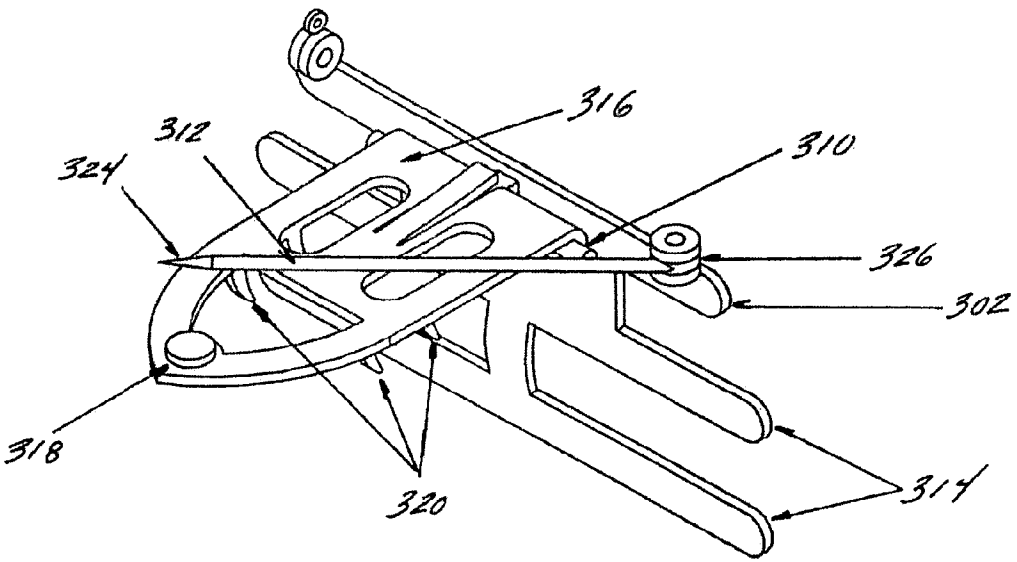
FIG. 5 depicts a rear angular view of the attachment device of FIG. 4 in accordance with the preferred embodiment of the present invention.

Turning next to FIG. 5, shown is a rear angular view of attachment device 302 in accordance with the preferred embodiment of the present invention. Shown is attachment device 302 connected to pin 312, exhibiting pointed end 324 at first end and attached to revolving pin hinge 326 at second end, and clip hinge 310 at a top portion of attachment device 302. Clip hinge 310, located at top portion of attachment device clip 316, is positioned proximate to pin 312, yet slightly lower on attachment device 302 so as to not interfere with free movement of pin 312 which is preferably set substantially perpendicular to attachment device 302. In FIG. 5, the preferred embodiment of the present invention is depicted in the open position as would exist prior to the fastening to a fashion item or like article. It should be noted that stopper device 318 is attached at a bottom end of attachment device clip 316 and attachment prongs 314 are located on the sides of attachment device 302.

Figure 6:
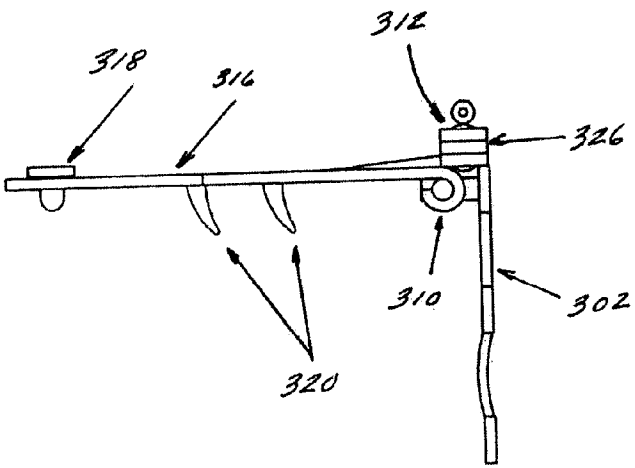
FIG. 6 depicts a side planar view of the attachment device of FIG. 4 associated with the preferred embodiment of the present invention.

Now referring to FIG. 6, depicted is a side planar view of attachment device 302 of the preferred embodiment of the present invention as shown with clip 316 in the open position. The illustration in FIG. 6 depicts pin 312 (substantially in the z-direction), affixed to pin hinge 326, connected at a top end of attachment device 302 and attachment device clip 316 connected to attachment device 302 at clip hinge 310. As shown, a plurality of pinching devices 320 are connected to clip 316 in such a way that upon fastening of attachment device 302 to a fashion item, pinching devices 320 will provide pressure to fashion item at pointed portions to prevent slippage. In the preferred embodiment depicted in FIG. 6, there are two such pinching devices 320 but the present invention contemplates any number of pinching devices 320 to assist in the reduction of slippage with respect to a fashion item. In addition, according to the preferred embodiment of the present invention pinching devices 320 are manufactured as a part of attachment device clip 316 though one of ordinary skill in the art would recognize that pinching devices 320 can be separately manufactured or removably attachable without departing from the scope of the present invention.

Still referring to FIG. 6, shown is stopper device 318 as connected to a bottom end of attachment device clip 316. As depicted, stopper device 318 generally maintains a tubular shape whereby the outside end of stopper apparatus is flat in order minimize the intrusion of stopper apparatus with the ornamental devices (not pictured in FIG. 6) as will be described in further detail below. In this design, stopper device 318 is connected at the substantially central axis of lower potion of attachment device clip 316 and extends to the inside area of attachment device clip 316 in order to provide increased friction with the fashion item to which attachment device 302 is connected.

Figure 7B:
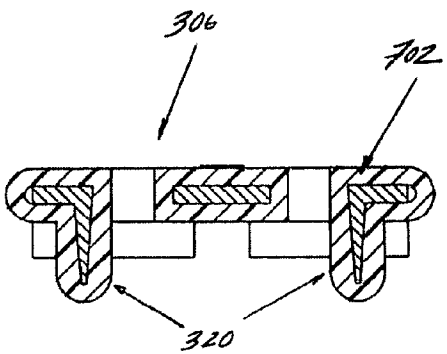
FIGS. 7A-7B depict front angular and cross-section views of the ornamental clip associated with the preferred embodiment of the present invention.
Figure 7A:
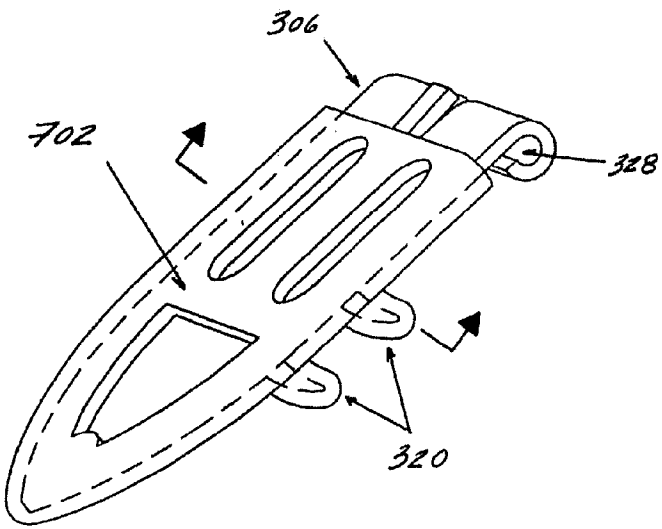

FIGS. 7A and 7B depict front angular and cross-section views respectively of ornamental device clip 306 associated with the preferred embodiment of the present invention. Ornamental device clip 306 includes ornamental device clip hinge 328 located at one end of ornamental device clip 306. Specifically, ornamental device clip 306 (including pinching devices 320) is depicted as being coated with comfort overlay 702. In accordance with the preferred embodiment of the present invention, comfort overlay 702 enhances the comfort of the ornamental device clip 306 when applied to desired object. According to the preferred embodiment of the present invention, comfort overlay 702 is manufactured from a soft or spongy material, including but not limited to elastomer type polymers such as natural or synthetic rubber or an addition polymer such as polyethylene, polypropylene, poly(vinyl chloride), poly(vinylidene chloride), polystyrene, polyacrylonitrile, polytetrafluoroethylene, poly(methyl methacrylate), poly(vinyl acetate), cis-polyisoprene, and polychloroprene. While the referenced materials are contemplated in accordance with the preferred embodiment of the present invention, other soft or spongy materials may be utilized in the manufacture of comfort overly 702.

Figure 8B:
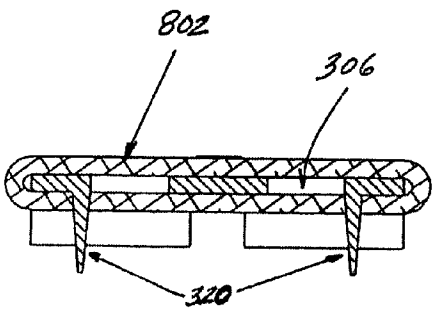
FIGS. 8A-8B depict front angular and cross-section views of the ornamental clip associated with an alternate embodiment of the present invention.
Figure 8A:
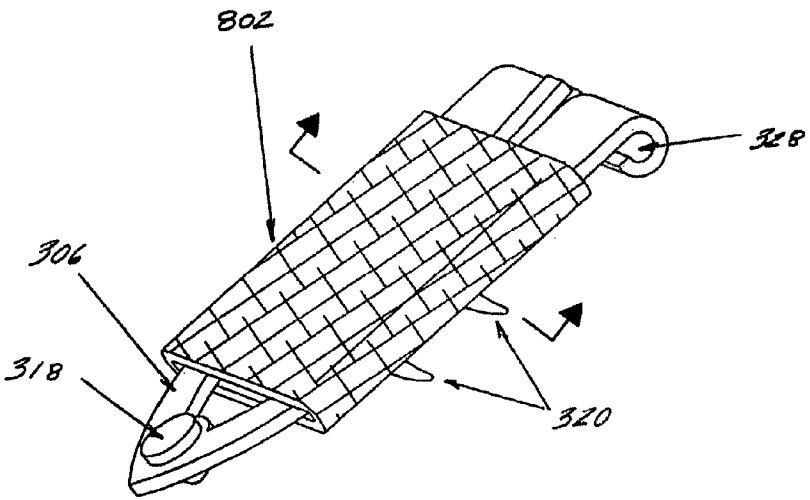

Similarly, FIGS. 8A-8B depict front angular and cross-section views of ornamental clip 306 associated with an alternate embodiment of the present invention exhibiting device clip hinge 328 located at one end of ornamental device clip 306, pinching devices 320, and stopper device 318. Specifically, to provide increased comfort to a wearer, sleeve device 802 may be employed to further coat ornamental device clip 306. Sleeve device 802 is preferably removably attachable to allow the user of the ornamental device 304 attached to ornamental device clip 306 to adjust the degree of comfort and snugness of the device. To increase comfort and snugness the user utilizes sleeve device 802 in conjunction with the preferred embodiment of the present invention. To eliminate any tightness associated with the wearing of such an ornamental device, the user would discard sleeve device 802 and utilize the preferred embodiment of the invention as described and depicted in connection with FIGS. 7A and 7B above.

Figure 9:
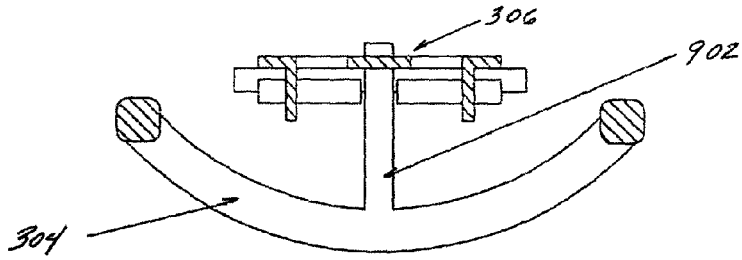
FIG. 9 depicts a top planar view of the ornamental clip in accordance with the preferred embodiment of the present invention.

Turning next to FIG. 9, depicted is a top planar view of ornamental device clip 304 in accordance with the preferred embodiment of the present invention. FIG. 9 shows the connection of ornamental device clip 306 to ornamental device 304. More specifically, ornamental device clip 306 is connected to a first end of bridge 902 and ornamental device clip 306 is connected to a second end of bridge 902 in a substantially perpendicular direction. Bridge 902 is manufactured of a similar material as ornamental device clip 306 and ornamental device 304 and extends in order to provide a space between ornamental device 304 and ornamental device clip 306. The space generated by bridge 902 is required in the embodiment of the present invention wherein ornamental device 304 is attached to a narrow fashion item, such as a necklace or pendant. In this case, the width of the pendant or necklace rests between ornamental device clip 306 and ornamental device 304 with bridge 902 when resting on such pendant or necklace. While FIG. 9 is described as being optimal for use with a pendant or necklace (as further depicted in FIG. 15), one of ordinary skill in the art will recognize other uses for which bridge 902 would be beneficial, including but not limited to purse straps, tank top straps, evening gown straps and bracelets.

Figure 10:
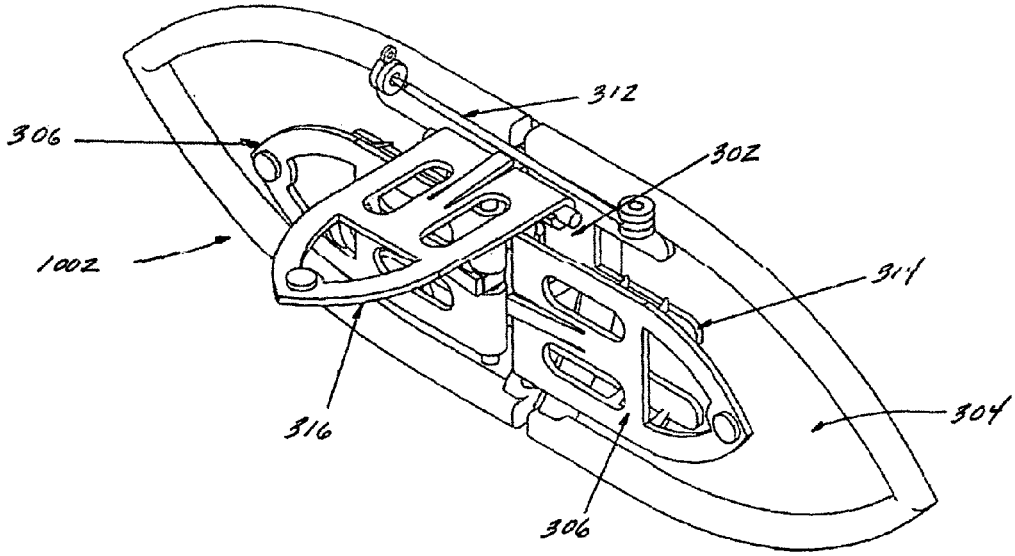
FIG. 10 depicts a rear angular view of the attachment device and ornamental clips of FIG. 3 in an assembled manner in accordance with the preferred embodiment of the present invention.

Next referring to FIG. 10, depicted is a rear angular view of the attachment device and ornamental clips in an assembled manner in accordance with the preferred embodiment of the present invention. Specifically, attachment device 302 is connected to ornamental device 304 by fastening attachment prongs 314 to ornamental device clips 306. According to the preferred embodiment of the present invention, when secured on both ends attachment device 302 connects two ornamental devices 304 to form a single ornamental unit 1002. While the preferred embodiment of the present invention describes the interconnection of two ornamental devices 304, one of ordinary skill in the art will recognize that the connection of any number of ornamental devices 304 to form a single ornamental unit 302 would not depart from the scope of the present invention.

Still referring to FIG. 10, shown is attachment device clip 316, including pin 312, as it functions to secure ornamental devices 304 to form ornamental unit 1002. When in the closed position, attachment device clip 316 operates to prevent each ornamental unit 304 from detaching from attachment device 302.

Figure 11:
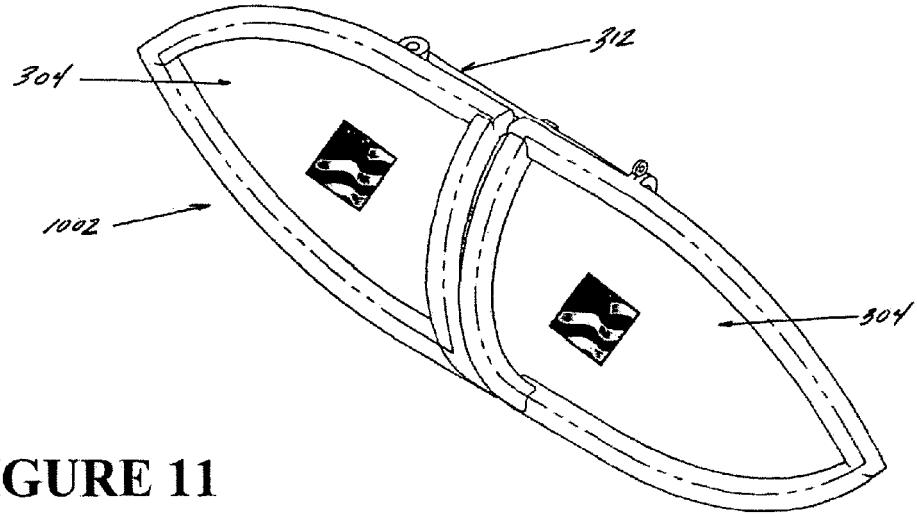
FIG. 11 depicts a front angular view of the attachment device and ornamental clips of FIG. 3 in accordance with the preferred embodiment of the present invention.
Figure 12:
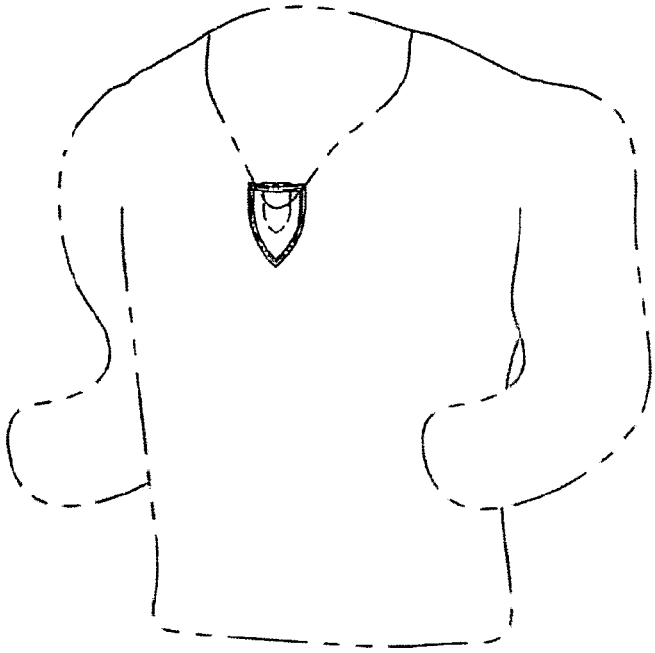
FIG. 12 depicts an application of the attachment device of FIG. 3 in an assembled manner adorning a clothing garment in accordance with the preferred embodiment of the present invention.

Referring next to FIG. 11, depicted is a front angular view of the attachment device and ornamental clips in accordance with the preferred embodiment of the present invention. FIG. 11 shows single ornamental unit 1002 as constructed from two individual ornamental units 304. The design on the front face of each ornamental device 304 (denoted by an American flag image) can be any desired ornamental image such as paintings, enamels, jewel-adorned, etc., and the present invention contemplates that the American flag image design of each ornamental device 304 can be identical, similar or completely different and not depart from the scope of the present invention. Further, as depicted, single ornamental 1002 can be worn as a broach by enabling pin 312 or can adorn various objects such as those depicted in FIG. 12 through FIG. 15. One of ordinary skill in the art will also appreciate that different attachment mechanisms can be substituted for the mechanism depicted without departing from the scope of the present invention.

Figure 13:
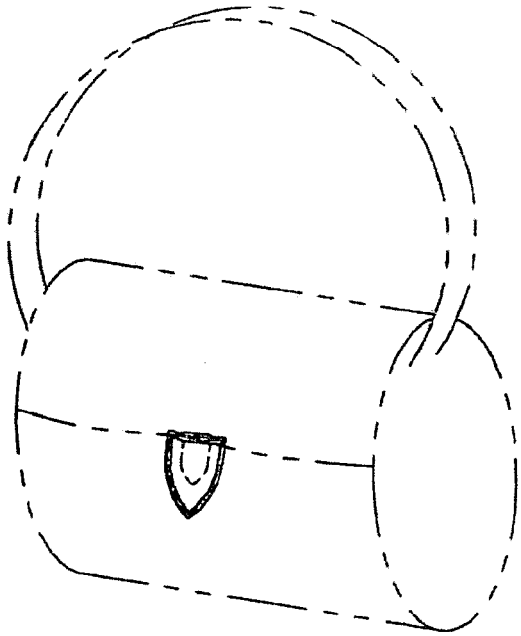
FIG. 13 depicts an application of the attachment device of FIG. 3 in an assembled manner adorning an accessory fashion item in accordance with the preferred embodiment of the present invention.
Figure 14:
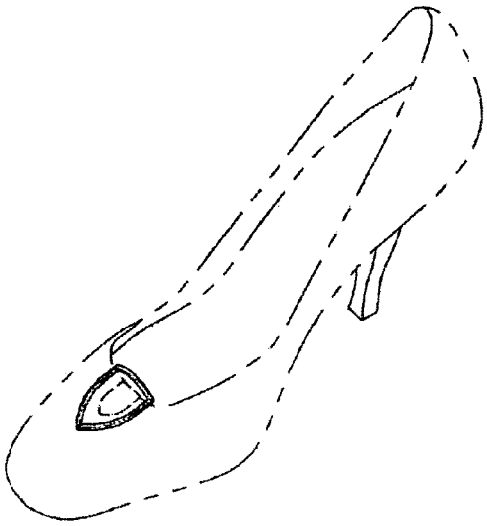
FIG. 14 depicts an application of the attachment device of FIG. 3 in an assembled manner adorning a shoe in accordance with the preferred embodiment of the present invention.
Figure 15:
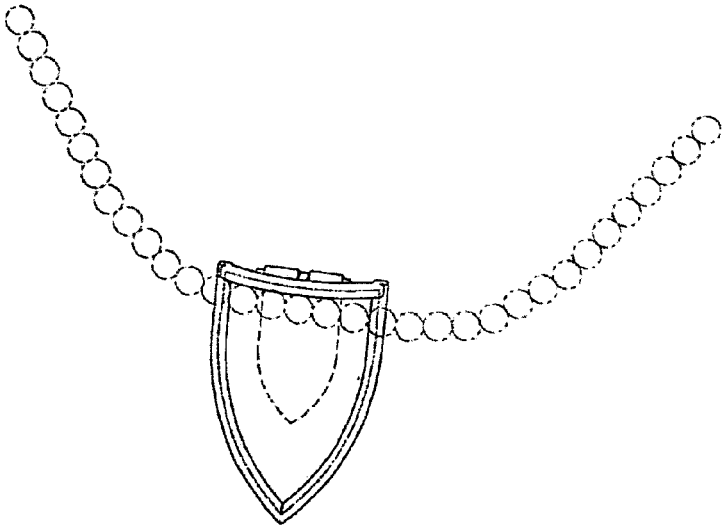
FIG. 15 depicts an application of the attachment device of FIG. 3 in an assembled manner adorning a jewelry piece in accordance with the preferred embodiment of the present invention.

Referring to FIG. 12 through FIG. 15, depicted is various applications for the above-disclosed devices of the present invention. In particular, the present disclosure is directed to a simple and effective single securing apparatus which a user may attach to various objects including fashion accessories, home design accessories, pet products and accessories, beauty objects, or any other device which exhibits an area portion suitable for affixing an ornamental clip thereto. Specifically, FIG. 12 demonstrates the application of the device of the present disclosure for adorning a clothing garment. FIG. 13 depicts the device attached to a fashion accessory such as a purse while FIG. 14 demonstrates the use of a device with an article of footwear. Further, FIG. 15 shows the device of the present invention adorning an article of jewelry. From these depictions, one of ordinary skill in the art will readily recognize the mass application of the present disclosure to various other articles of commerce.

From the foregoing description of the embodiments, which embodiments have been set forth in considerable detail for the purpose of making a complete disclosure of the present invention, it can be seen that the present invention comprises a grip material for increasing the friction between human fingers and a foreign object by providing an intermediate object with a face having increased friction. It will be appreciated by those skilled in the art that changes could be made to the embodiment described above without departing from the broad inventive concept thereof. It is understood, therefore, that this invention is not limited to the particular embodiment disclosed, but it is intended to cover all modifications that are within the scope and spirit of the invention as defined by the appended claims.

What is claimed is:

1. A method for mounting an attachment device to an article, the method including the steps of:

first sliding an attachment device of substantially triangular dimension, composed of an outside exposed portion and an underside portion, in an open position and hinged at a clip hinge, and comprising an attachment device clip, a stopper device, and a pinching device on an underside portion and an ornamental device on outside exposed portion, under an area of the article until said clip hinge of the attachment device is placed proximate to a rim area of the article; and second rigidly clamping the outside exposed portion and the underside portion of the attachment device by applying force thereto to activate the clip hinge and secure the article therebetween.

2. A method for mounting an attachment device to an article, the method including the steps of:

assembling a first ornamental device to a left side of said attachment device and a second ornamental device to a right side of said attachment device to create a single ornamental unit;

sliding said single ornamental unit, composed of an outside exposed portion exhibiting said first ornamental device and said second ornamental device and an underside portion, in an open position and hinged at a clip hinge, and comprising an attachment device clip, a stopper device, and a pinching device on said underside portion and said outside exposed portion, under an area of the article until said clip hinge of the attachment device is placed proximate to a rim area of the article; and second rigidly clamping an outside exposed portion and an underside portion of the attachment device by applying force thereto to activate the clip hinge and secure the article therebetween, whereby said force exerted on said article positioned between said exposed portion and the underside portion of the attachment device prevents movement of said attachment device aided by said pinching device.

3. An attachment device comprising:

a pin portion at a top portion of said attachment device, fixed at a pin hinge at a first end and comprising a pointed end for securing at a loop portion of said attachment device;

an attachment device clip perpendicularly affixed by a clip hinge to said attachment device;

a plurality of attachment prongs extending outwardly from the centerline of said attachment device for accepting and securing a plurality of ornamental devices;

a comfort overlay;

wherein said comfort overly is manufactured of a soft, spongy material selected from the group consisting of polymer, polyethylene, polypropylene, poly(vinyl chloride), poly(vinylidene chloride), polystyrene, polyacrylonitrile, polytetrafluoroethylene, poly(methyl methacrylate), poly(vinyl acetate), cis-polyisoprene, or polychloroprene.

4. The attachment device of claim 3 wherein said attachment device clip is substantially triangular so to allow a user to insert said attachment device clip under an article.

5. The attachment device of claim 3 wherein said attachment device is manufactured of a rigid material selected from the group consisting of precious metal, semi-precious metal, non-precious metal, plastic, or resin.

6. The attachment device of claim 3 wherein said attachment device clip further comprises a stopper attached to a lower portion of said attachment device clip.

7. The attachment device of claim 6 wherein said attachment device is manufactured of a rigid material selected from the group consisting of precious metal, semi-precious metal, or non-precious metal, and said stopper is designed to maintain a coefficient of friction greater than that of the metallic surface of said attachment device clip to decrease slippage of attachment device clip when in contact with said article.

8. The attachment device of claim 6 wherein said stopper is manufactured of a soft, substantially flexible material selected from the group consisting of rubber, resin, polypropylene, or polyurethane.

9. The attachment device of claim 6 wherein said stopper is provided with a cushion.

10. The attachment device of claim 3 wherein said pin portion is positioned above said clip hinge so as to allow for free movement of the pin restricted only by said pin hinge allowing a user to pin the attachment device.

11. The attachment device of claim 3 wherein said plurality of ornamental devices are removably attached to said attachment device by a plurality of ornamental clips comprised of device clip hinge, plurality of pinching devices, and plurality of stopper devices.

12. The attachment device of claim 11 wherein said plurality of ornamental clips further comprises a plurality of sleeve devices designed to adjust the degree of comfort and fit of said ornamental device.

13. An attachment device comprising:

a pin portion at a top portion of said attachment device, fixed at a pin hinge at a first end and comprising a pointed end for securing at a loop portion of said attachment device;

an attachment device clip perpendicularly affixed by a clip hinge to said attachment device; and a plurality of attachment prongs extending outwardly from the centerline of said attachment device for accepting and securing a plurality of ornamental devices;

wherein said plurality of ornamental devices are removably attached to said attachment device by a plurality of ornamental clips comprised of device clip hinge, plurality of pinching devices, and plurality of stopper devices.

14. The attachment device of claim 13 wherein said attachment device clip is substantially triangular so to allow a user to insert said attachment device clip under an article.

15. The attachment device of claim 13 wherein said attachment device is manufactured of a rigid material selected from the group consisting of precious metal, semi-precious metal, non-precious metal, plastic, or resin.

16. The attachment device of claim 13 wherein said attachment device clip further comprises a stopper attached to a lower portion of said attachment device clip.

17. The attachment device of claim 16 wherein said attachment device is manufactured of a rigid material selected from the group consisting of precious metal, semi-precious metal, or non-precious metal, and said stopper is designed to maintain a coefficient of friction greater than that of the metallic surface of said attachment device clip to decrease slippage of attachment device clip when in contact with said article.

18. The attachment device of claim 16 wherein said stopper is manufactured of a soft, substantially flexible material selected from the group consisting of rubber, resin, polypropylene, or polyurethane.

19. The attachment device of claim 13 wherein said pin portion is positioned above said clip hinge so as to allow for free movement of the pin restricted only by said pin hinge allowing a user to pin the attachment device.

20. The attachment device of claim 13 wherein said plurality of ornamental clips further comprises a plurality of sleeve devices designed to adjust the degree of comfort and fit of said ornamental device.

* * * * *